US009447486B2

(12) United States Patent
Nemoto et al.

(10) Patent No.: US 9,447,486 B2
(45) Date of Patent: Sep. 20, 2016

(54) NI-BASED ALLOY FOR CASTING USED FOR STEAM TURBINE AND CASTING COMPONENT OF STEAM TURBINE

(75) Inventors: Kuniyoshi Nemoto, Yokohama (JP); Yomei Yoshioka, Yokohama (JP); Kiyoshi Imai, Tokyo (JP); Shigekazu Miyashita, Yokohama (JP); Takeo Suga, Yokohama (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 447 days.

(21) Appl. No.: 13/487,633

(22) Filed: Jun. 4, 2012

(65) Prior Publication Data

US 2012/0315133 A1 Dec. 13, 2012

(30) Foreign Application Priority Data

Jun. 10, 2011 (JP) ..... 2011-130309

(51) Int. Cl.
*C22C 19/05* (2006.01)
*C22F 1/10* (2006.01)

(52) U.S. Cl.
CPC ..... *C22C 19/055* (2013.01); *C22C 19/056* (2013.01); *C22F 1/10* (2013.01)

(58) Field of Classification Search
CPC ..... C22C 19/055; C22C 19/056; C22F 1/10
See application file for complete search history.

(56) References Cited

U.S. PATENT DOCUMENTS

| | | | | |
|---|---|---|---|---|
| 3,785,877 | A * | 1/1974 | Bailey | 148/556 |
| 4,093,476 | A | 6/1978 | Boesch | |
| 5,372,662 | A | 12/1994 | Ganesan et al. | |
| 7,484,926 | B2 | 2/2009 | Suga et al. | |
| 7,524,162 | B2 * | 4/2009 | Reigl | 415/104 |
| 8,828,313 | B2 * | 9/2014 | Nemoto et al. | 420/448 |
| 2003/0185675 | A1 * | 10/2003 | Turnquist et al. | 415/178 |
| 2006/0222557 | A1 | 10/2006 | Pike, Jr. | |
| 2009/0285692 | A1 * | 11/2009 | Nemoto et al. | 416/241 R |
| 2010/0158681 | A1 | 6/2010 | Nemoto et al. | |
| 2010/0158682 | A1 | 6/2010 | Nemoto et al. | |
| 2010/0166594 | A1 * | 7/2010 | Hirata et al. | 420/443 |
| 2011/0064569 | A1 | 3/2011 | Yamada et al. | |

FOREIGN PATENT DOCUMENTS

| | | | |
|---|---|---|---|
| CN | 1854464 | A | 11/2006 |
| CN | 101818286 | A | 9/2010 |
| EP | 2 204 462 | A1 | 7/2010 |
| EP | 2 206 795 | A2 | 7/2010 |
| EP | 2 206 795 | A3 | 7/2010 |
| EP | 2 309 010 | A1 | 4/2011 |
| JP | 2003-113434 | A | 4/2003 |
| JP | 2009-84684 | A | 4/2009 |
| JP | 2010-150585 | A | 7/2010 |
| JP | 2010-215989 | A | 9/2010 |
| JP | 2011-219787 | | 11/2011 |

OTHER PUBLICATIONS

Extended European Search Report issued Nov. 22, 2012, in European Patent Application No. 12170979.4.
Combined Chinese Office Action and Search Report issued Nov. 25, 2013 in Patent Application No. 201210189744.3 (with English language translation).

* cited by examiner

*Primary Examiner* — Jessee Roe
(74) *Attorney, Agent, or Firm* — Oblon, McClelland, Maier & Neustadt, L.L.P

(57) ABSTRACT

An Ni-based alloy for casting used for a steam turbine of an embodiment contains in percent (%) by mass C (carbon): 0.01 to 0.1, Cr (chromium): 15 to 25, Co (cobalt): 10 to 15, Mo (molybdenum): 5 to 12, Al (aluminum): 0.5 to 2, Ti (titanium): 0.3 to 2, B (boron): 0.001 to 0.006, Ta (tantalum): 0.05 to 1, Si (silicon): 0.1 to 0.5, Mn (manganese): 0.1 to 0.5, and the balance of Ni (nickel) and unavoidable impurities.

11 Claims, No Drawings

NI-BASED ALLOY FOR CASTING USED FOR STEAM TURBINE AND CASTING COMPONENT OF STEAM TURBINE

CROSS-REFERENCE TO RELATED APPLICATION

This application is based upon and claims the benefit of priority from the prior Japanese Patent Application No. 2011-130309, filed on Jun. 10, 2011; the entire contents of which are incorporated herein by reference.

FIELD

Embodiments described herein relate generally to an Ni-based alloy for casting used for a steam turbine and a casting component of a steam turbine.

BACKGROUND

In a thermal power plant including a steam turbine, technology to suppress emissions of carbon oxide is gaining attention in view of preserving global environment, and there are increasing needs to enhance efficiency of power generation.

To enhance power generating efficiency of a steam turbine, it is effective to increase a turbine steam temperature. In recent thermal power plants equipped with a steam turbine, a steam temperature is increased to equal to or higher than 600° C., and the temperature is showing a tendency to be increased to 650° C., and further to 700° C. in the future.

Around a turbine casing, a valve casing, a nozzle box, and a pipe, of the steam turbine, which is exposed to high temperature steam, high temperature steam circulates and increases their temperatures, and high stresses occur. Accordingly, the above are required to endure a high temperature and a high stress, and as a material constituting the above, there is demanded a material having superior strength, ductility, and toughness in a scope ranging from a room temperature to a high temperature.

Particularly when the steam temperature is over 700° C., a conventional iron-based material is insufficient in terms of high temperature strength, and therefore application of an Ni (nickel)-based alloy is considered. Due to its superior high temperature strength property and corrosion resistance, the Ni-based alloys have been widely applied mainly as materials for jet engines and gas turbines. As typical examples, Inconel 617 alloy (manufactured by Special Metals Corporation) and Inconel 706 alloy (manufactured by Special Metals Corporation) are used.

To enhance high temperature strength of an Ni-based alloy, there is a method in which either one of precipitated phases of a precipitated phase called a γ' (gamma prime: $Ni_3(Al, Ti)$) phase or a precipitated phase γ" (gamma double prime: $Ni_3Nb$) phase is precipitated or both the phases are precipitated in a parent phase material of the Ni-based alloy by adding Al and Ti. As what secures the high temperature strength by precipitating both the precipitated phases of the γ' ($Ni_3(Al, Ti)$) phase and the precipitated phase γ" ($Ni_3Nb$) phase, the Inconel 706 alloy, for example, can be cited.

On the other hand, there is also an Ni-based alloy in which Co (cobalt) and Mo (molybdenum) are added to strengthen (solid solution strengthening) a parent phase of an Ni base to ensure high temperature strength, such as Inconel 617 alloy.

As described above, as a material for a component of steam turbine for steam over 700° C., application of an Ni-based alloy is considered. It is demanded to improve high temperature strength of the Ni-based alloy by composition improvement or the like, while maintaining castability of the Ni-based alloy.

DETAILED DESCRIPTION

Hereinafter, an embodiment of the present invention will be described.

An Ni-based alloy for casting used for a steam turbine according to the embodiment is constituted in a range of constituents shown below. It should be noted that "%" representing the constituents in the following explanation means "% by mass", unless otherwise specified.

(M1) An Ni-based alloy containing C (carbon): 0.01 to 0.1%, Cr (chromium): 15 to 25%, Co (cobalt): 10 to 15%, Mo (molybdenum): 5 to 12%, Al (aluminum): 0.5 to 2%, Ti (titanium): 0.3 to 2%, B (boron): 0.001 to 0.006%, Ta (tantalum): 0.05 to 1%, Si (silicon): 0.1 to 0.5%, Mn (manganese): 0.1 to 0.5%, and the balance of Ni (nickel) and unavoidable impurities.

(M2) An Ni-based alloy containing C (carbon): 0.01 to 0.1%, Cr (chromium): 15 to 25%, Co (cobalt): 10 to 15%, Mo (molybdenum): 5 to 12%, Al (aluminum): 0.5 to 2%, Ti (titanium): 0.3 to 2%, B (boron): 0.001 to 0.006%, Nb (niobium): 0.025 to 0.5%, Si (silicon): 0.1 to 0.5%, Mn (manganese): 0.1 to 0.5%, and the balance of Ni (nickel) and unavoidable impurities.

(M3) An Ni-based alloy containing C (carbon): 0.01 to 0.1%, Cr (chromium): 15 to 25%, Co (cobalt): 10 to 15%, Mo (molybdenum): 5 to 12%, Al (aluminum): 0.5 to 2%, Ti (titanium): 0.3 to 2%, B (boron): 0.001 to 0.006%, Si (silicon): 0.1 to 0.5%, Mn (manganese): 0.1 to 0.5%, a sum of Ta (tantalum) and Nb (niobium) (content ratios of Ta (tantalum) and Nb (niobium) are at least equal to or more than 0.01%): 0.1 to 1%, and the balance of Ni (nickel) and unavoidable impurities.

Here, in the Ni-based alloys of the above-described (M1) to (M3), it is preferable that a content ratio of a sum of Al and Ti is within a range of 1 to 3 mass %.

Further, in the Ni-based alloy of the above-described (M3), it is preferable that it is constituted that the total number of moles obtained by summing up the numbers of moles of Ta and Nb is equal to the number of moles of Ta obtained by converting mass of a sum of Ta and Nb into mass of Ta.

Further, as unavoidable impurities in the Ni-based alloys of the above-described (M1) to (M3), for example, cu, Fe, P, S and so on can be cited.

The Ni-based alloy in the above-described range of constituents is suitable as a material constituting a casting component of a steam turbine whose temperature at operation becomes 680 to 750° C. As the casting components of the steam turbine, for example, a turbine casing, a valve casing, a nozzle box, a pipe and so on can be cited.

Here, the turbine casing is a casing through which a turbine rotor with an embedded turbine rotor blade penetrates, which is provided with a nozzle in an inner peripheral surface, and which constitutes a turbine compartment into which steam is led. The valve casing is a casing of a valve which functions as a steam valve adjusting a flow rate of high-temperature high-pressure steam to be supplied to the steam turbine and shutting out a flow of steam. Particularly, a casing of a valve where steam having a temperature of 680 to 750° C. flows can be cited as an example. The nozzle box is a ring-shaped steam channel provided in a periphery of the turbine rotor, the steam channel leading out high-temperature high-pressure steam having been led into the steam turbine toward a first stage constituted by a first-stage nozzle (stationary blade) and a first-stage turbine rotor blade. The pipe is a main steam pipe or a reheated steam pipe which leads steam from a boiler to the steam turbine. Those turbine casing, valve casing, nozzle box, and pipe are all disposed in an environment exposed to high-temperature high-pressure steam.

Here, the whole part of the casting components of the steam turbine described above may be constituted by the above-described Ni-based alloy, or particularly a part of the casting components of the steam turbine that comes to have a high temperature may be constituted by the above-described Ni-based alloy. Here, as an area of the casting components of the steam turbine coming to have a high temperature, there can be cited, concretely, for example, the entire area of a high-pressure steam turbine unit or an area from the high-pressure steam turbine unit to a part of an intermediate-pressure steam turbine unit. Further, as an area of the casting component of the steam turbine coming to have a high temperature, a main steam line unit which leads steam to the high-pressure steam turbine can be cited. It should be noted that areas of the casting components of the steam turbine coming to have high temperatures are not limited to the above and, for example, an area coming to have a temperature of about 680 to 750° C. is also included therein.

Meanwhile, the Ni-based alloy in the constituent range described above is superior to a conventional Ni-based alloy in the high temperature strength property and castability. In other words, by constituting casting components of a steam turbine such as a turbine casing, a valve casing, a nozzle box, a pipe and so on by using this Ni-based alloy, it is possible to fabricate a casting component having high reliability under a high temperature environment.

Next, reasons for the limitations of the respective constituent ranges in the above-described Ni-based alloys according to the present invention will be described.

(1) C (Carbon)

C is useful as a constituent element of an $M_{23}C_6$ type carbide being a strengthened phase. Particularly under a high temperature environment of equal to or higher than 650° C., one of factors of maintaining creep strength of an alloy is to cause the $M_{23}C_6$ type carbide to precipitate while the steam turbine is operating. Further, C also has an effect to secure fluidity of molten metal at a time of casting. When a content ratio of C is less than 0.01%, a sufficient precipitation amount of the carbide cannot be secured, and thus mechanical strength (high temperature strength, the same hereinafter) decreases, and the fluidity of molten metal at the time of casting decreases significantly. On the other hand, when the content ratio of C is over 0.10, a constituent segregation trend increases when producing a large ingot. Hence, the content ratio of C is 0.01% to 0.1%. Further, it is more preferable that the content ratio of C is 0.02 to 0.08%, and it is further preferable that the content ratio of C is 0.03 to 0.070.

(2) Cr (Chromium)

Cr is an essential element to enhance oxidation resistance, corrosion resistance and mechanical strength of the Ni-based alloy. Moreover, Cr is essential as a constituent element of the $M_{23}C_6$ type carbide. Particularly under the high temperature environment of equal to or more than 650° C., the creep strength of the alloy is maintained by causing the $M_{23}C_6$ type carbide to precipitate while the steam turbine is operating. Further, Cr enhances the oxidation resistance under the high-temperature steam environment. When a content ratio of Cr is less than 15%, the oxidation resistance decreases. On the other hand, when the content ratio of Cr is over 25%, a trend to be coarse is enhanced by significantly facilitating the precipitation of the $M_{23}C_6$ type carbide. Further, due to precipitation of a σ phase being a harmful phase, the mechanical strength decreases. Hence, the content ratio of Cr is 15 to 25%. Further, it is more preferable that the content ratio of Cr is 17 to 23%, and it is further preferable that the content ratio of Cr is 18 to 20%.

(3) Co (Cobalt)

Co improves mechanical strength of a parent phase in the Ni-based alloy by solid-solving in the parent phase. However, when a content ratio of Co is over 15%, an intermetallic compound phase which decreases the mechanical strength is generated, and the mechanical strength decreases. On the other hand, when the content ratio of Co is less than 10%, castability decreases, and further, the mechanical strength decreases. Hence, the content ratio of Co is 10 to 15%. Further, it is preferable that the content ratio of Co is 12 to 14%.

(4) Mo (Molybdenum)

Mo has an effect to improve the mechanical strength of the parent phase by solid-solving in the Ni parent phase. Further, Mo enhances stability of a carbide by partially replacing in the $M_{23}C_6$ type carbide. When a content ratio of Mo is less than 5%, the above-described effect is not exhibited. On the other hand, when the content ratio of Mo is over 12%, the component segregation trend when producing the large ingot increases, and the mechanical strength decreases due to a phase precipitation. Hence, the content ratio of Mo is 5 to 12%. Further, it is more preferable that the content ratio of Mo is 7 to 11% and it is further preferable that the content ratio of Mo is 8 to 10%.

(5) Al Aluminum

Al generates a γ' ($Ni_3Al$) phase together with Ni and improves the mechanical strength of the Ni-based alloys by precipitation. When a content ratio of Al is less than 0.5%, the mechanical strength is not improved as compared with a case of conventional steel. On the other hand, when the content ratio of Al is over 2%, the mechanical strength is improved but castability decreases. Hence, the content ratio of Al is 0.5 to 2%. Further, it is more preferable that the content ratio of Al is 0.5 to 1.4%, and it is further preferable that the content ratio of Al is 0.7 to 1.3%.

(6) Ti (Titanium)

Ti is an element which replaces Al in the γ' ($Ni_3Al$) phase to generate ($Ni_3(Al, Ti)$) and which is helpful in solid solution strengthening of the γ' phase. When a content ratio of Ti is less than 0.3%, the above-described effect is not exhibited. On the other hand, when the content ratio of Ti is over 2%, precipitation of an $Ni_3Ti$ phase (η phase) and a nitride of Ti is facilitated, resulting in decrease of the mechanical strength and castability. Hence, the content ratio of Ti is 0.3 to 2%. It is more preferable that the content ratio of Ti is 0.5 to 1.5%, and it is further preferable that the content ratio of Ti is 0.6 to 1.3%.

Further, by containing Al and Ti described above in a range of a content ratio of a sum (Al+Ti) of Al and Ti being 1 to 3%, the γ' ($Ni_3(Al, Ti)$) phase is strengthened and the mechanical strength is improved. When the content ratio of (Al+Ti) is less than 1%, improvement of the mechanical strength is not seen in the above-described effect as compared with the conventional steel. On the other hand, when the content ratio of (Al+Ti) is over 3%, the mechanical strength is improved but castability tends to decrease.

Hence, in the Ni-based alloy according to the present invention, it is preferable that the content ratio of (Al+Ti) is 1 to 3%. Further, it is more preferable that the content ratio of (Al+Ti) is 1.3 to 2.7% and it is further preferable that the content ratio of (Al+Ti) is 1.5 to 2.5%.

(7) B (Boron)

B precipitates into the Ni parent phase and has an effect to improve the mechanical strength of the parent phase. When a content ratio of B is less than 0.001%, the effect to improve the mechanical strength of the parent phase is not exhibited. On the other hand, when the content ratio of B is over 0.006%, it may lead to grain boundary embrittlement. Hence, the content ratio of B is 0.001 to 0.006%. Further, it is more preferable that the content ratio of B is 0.002 to 0.005%.

(8) Ta (Tantalum)

Ta can strengthen the γ' phase by solid-solving in the γ' ($Ni_3$(Al, Ti)) phase and stabilizes the γ' phase. When a content ratio of Ta is less than 0.05%, improvement is not seen in the above-described effect as compared with the conventional steel. On the other hand, when the content ratio of Ta is over 1%, economic efficiency is impaired, resulting in cost increase. Hence, the content ratio of Ta is 0.05 to 1%. Further, it is more preferable that the content ratio of Ta is 0.05 to 0.8% and it is further preferable that the content ratio of Ta is 0.05 to 0.5%.

(9) Nb (Niobium)

Nb, similarly to Ta, strengthens by solid-solving in the γ' ($Ni_3$(Al, Ti)) phase and stabilizes the γ' phase. Nb, which is lower in price than Ta, is economical. When a content ratio of Nb is less than 0.025%, improvement is not seen in the above-described effect as compared with the conventional steel. On the other hand, when the content ratio of Nb is over 0.5%, the mechanical strength is improved but castability decreases. Hence, the content ratio of Nb is 0.025 to 0.5%. It is more preferable that the content ratio of Nb is 0.05 to 0.5%, and it is further preferable that the content ratio of Nb is 0.1 to 0.4%.

Further, by a content ratio of a sum (Ta+Nb) of above-described Ta and Nb being 0.1 to 1%, the precipitation strength of the γ' phase ($Ni_3$(Al, Ti)) is improved and further long-term stability of a composition can be enhanced. When the content ratio of (Ta+Nb) is less than 0.1%, improvement cannot seen in the above-described effect as compared with the conventional steel. On the other hand, when the content ratio of (Ta+Nb) is over 1%, the mechanical strength is improved but castability decreases. Hence, the content ratio of (Ta+Nb) is 0.1 to 1%. Further, it is more preferable that the content ratio of (Ta+Nb) is 0.2 to 0.9%. It should be noted that when both Ta and Nb are contained, Ta and Nb are each contained at least equal to or more than 0.01%.

Further, when the content ratio of the sum (Ta+Nb) of Ta and Nb is 0.1 to 1%, it is preferable that the total number of moles obtained by summing up the numbers of moles of Ta and Nb is equal to the number of moles of Ta obtained by converting mass of the sum of Ta and Nb into mass of Ta.

As described above, as a result that the total number of moles obtained by summing up the numbers of the moles of Ta and Nb is made equal to the number of moles of Ta obtained by converting mass of the sum of Ta and Nb into mass of Ta, an effect similar to that of a case of Ta can be obtained even in a case that Ta and Nb are contained. Further, since Nb is low in price as compared with Ta, a manufacturing cost can be curtailed.

Here, making the total number of moles obtained by summing up the numbers of moles of Ta and Nb equal to the number of moles of Ta obtained by converting mass of the sum of Ta and Nb into mass of Ta will be described.

The number of moles of Ta obtained by converting mass of the sum of Ta and Nb into mass of Ta is represented by Amol. Also in a case that both Ta and Nb are contained, it is constituted that the total number of moles being the sum of the numbers of moles of Ta and Nb becomes the above Amol.

For example, if B % of Amol being the number of moles of Ta obtained by conversion into mass of Ta is replaced by Nb and added, the added number of moles of Nb is "A×B/100=Cmol", and an added amount of Nb is "C×92.91 (atomic weight of Nb)". Further, the added number of moles of Ta after B % of Amol is replaced by Nb is "A−C=Dmol", and an added amount of Ta is "D×180.9 (atomic weight of Ta)".

Further, concrete explanation will be done. For example, mass of Ta in a case that only Ta is added by 0.5% by mass in 100 (kg) of an Ni-based alloy is "100000×0.005=500 (g)". Then, the total number of moles of Ta is "500/180.9 (atomic weight of Ta)=2.764 (mol)". For example, if 400 of the total number of moles of Ta is replaced by Nb, an added amount of Nb is "2.764×0.4×92.91 (atomic weight of Nb)=102.72 (g)". This addition ratio of Nb is "102.72/100000×100=0.1%" in relation to 100 (kg) of the Ni-based alloy.

On the other hand, an added amount of Ta is "2.764×0.6×180.9=300 (g)". Then, an addition ratio of the sum of Ta is "300/100000×100=0.3%" in relation to 100 (kg) of the Ni-based alloy. Therefore, an addition ratio of the sum of Ta and Nb in the Ni-based alloy is "0.3+0.1=0.4%". Then, a total added amount of the sum of Ta and Nb is "300+102.72=402.72 (g)".

(10) Si (Silicon)

In a case of casting, Si has an effect to improve fluidity at a time of casting and improves castability. When a content ratio of Si is less than 0.1%, such an effect cannot be seen. On the other hand, when the content ratio of Si is over 0.5%, castability and the mechanical strength decrease. Hence, the content ratio of Si is 0.1 to 0.5%. Further, it is more preferable that the content ratio of Si is 0.2 to 0.4%.

(11) Mn (Manganese)

S (sulfur), which causes brittleness in a case of ordinary steel, prevents brittleness as MnS as a result that Mn is added, and improves the mechanical strength. However, when a content ratio of Mn is less than 0.1%, such an effect cannot be seen. On the other hand, when the content ratio of Mn is over 0.5%, the mechanical strength decreases. Hence, the content ratio of Mn is 0.1 to 0.5%. Further, it is more preferable that the content ratio of Mn is 0.2 to 0.3%.

(12) Cu (Copper), Fe (Iron), P (Phosphorus), and S (Sulfur)

Cu, Fe, P, and S are classified as unavoidable impurities in the Ni-based alloy of this embodiment. It is desired that remaining content ratios of these unavoidable impurities are made close to 0 (zero) % as much as possible.

Here, a method for manufacturing the Ni-based alloy for casting used for the steam turbine according to this embodiment and the casting component of the steam turbine manufactured by using this Ni-based alloy for casting will be described.

When manufacturing the Ni-based alloy for casting used for the steam turbine of this embodiment, constituents constituting the Ni-based alloy for casting is subjected to vacuum induction melting (VIM), and molten metal thereof is poured to a predetermined mold form to form an ingot. Then, by applying a solution treatment and an aging treatment to that ingot, the Ni-based alloy for casting is fabricated.

Further, when manufacturing the turbine casing, the valve casing, and the nozzle box being casting components of this embodiment, for example, constituents constituting the Ni-based alloy for casting of the steam turbine of this embodiment are subjected to vacuum induction melting (VIM), and molten metal thereof is poured to a molten form for forming to shapes of the turbine casing, the valve casing, and the nozzle box, then subjected to casting in air. Then, by applying a solution treatment and an aging treatment, the turbine casing, the valve casing, and the nozzle box are fabricated.

Further, as another method for manufacturing, constituents constituting the Ni-based alloy for casting used for the steam turbine of this embodiment are subjected to electric furnace melting (EF), argon oxygen decarburization (AOD) is performed, and molten metal thereof is poured to mold forms for forming to shapes of the turbine casing, the valve casing, and the nozzle box, then subjected to air casting. Then, by applying a solution treatment and an aging treatment, the turbine casing, the valve casing, and the nozzle box may be fabricated.

Further, when manufacturing the pipe being the casting component of this embodiment, constituents constituting the Ni-based alloy for casting used for the steam turbine of this embodiment are made to be molten metal by performing vacuum induction melting (VIM), or made to be molten metal by performing electric furnace melting (EF) and argon oxygen decarburization (AOD). Then, this molten metal is poured to a cylindrical mold in a state of being spinning at a high speed, and the molten metal is pressurized by using a centrifugal force of spinning and formed into a pipe shape. Then, by applying a solution treatment and an aging treatment, the pipe is fabricated (centrifugal casting method).

Here, in the above-described solution treatment, it is preferable to perform the treatment at a temperature in a range of 1100 to 1200° C. for 3 to 24 hours in correspondence with the casting component. Here, the solution treatment temperature is for solidifying a γ' phase precipitate evenly. When the solution treatment temperature is lower than 1100° C., solidification is not done sufficiently, and when the solution treatment temperature is over 1200° C., the strength decreases due to coarsening of a crystal grain.

Further, in the aging treatment, it is preferable that the treatment is performed at a temperature in a range of 700 to 800° C. for 10 to 48 hours in correspondence with the casting component. Thereby, it is possible to cause the γ' phase to precipitate early. Further, it is preferable that, as a first stage heat treatment, before the γ' phase is caused to precipitate, a treatment is performed at a temperature in a range of 1000 to 1050° C. for 10 to 48 hours, thereby to strengthen a grain boundary by causing $M_6C$ to precipitate into the grain boundary, and thereafter, as a second stage treatment, a treatment is performed at a temperature in a range of 700 to 800° C. for 10 to 48 hours, thereby to strengthen the grain inside by causing the γ' phase to precipitate.

It should be noted that methods for manufacturing the Ni-based alloy for casting used for the steam turbine, the turbine casing, the valve casing, the nozzle box, and the pipe, of this embodiment described above are not limited to the above-described methods.

Hereinafter, it is explained that the Ni-based alloy for casting used for the steam turbine of this embodiment is superior in the high-temperature strength property and castability. (Evaluation of high temperature strength property and castability)

Here, it is explained that the Ni-based alloy within a chemical composition range of this embodiment has superior high temperature strength property and castability. Table 1 represents chemical compositions of a sample 1 to a sample 23 used for evaluation of the high temperature strength property and castabiity. It should be noted that the sample 1 to a sample 9 are Ni-based alloys within the chemical composition range of this embodiment. On the other hand, a sample 10 to the sample 23 are Ni-based alloys whose compositions are not within the chemical composition range of this embodiment, being comparative examples. It should be noted that the Ni-based alloys within the chemical composition range of this embodiment used here contain Fe, Cu, S as unavoidable impurities.

TABLE 1

| | | Alloy Composition (% by mass) | | | | | | | | | | | | | | |
|---|---|---|---|---|---|---|---|---|---|---|---|---|---|---|---|---|
| | | Ni | C | Si | Mn | Cr | Fe | Al | Ti | Mo | Co | Cu | B | S | Ta | Nb |
| EXAMPLE | Sample 1 | Balance | 0.070 | 0.35 | 0.15 | 23.50 | 1.58 | 1.82 | 0.30 | 9.34 | 13.14 | 0.1 | 0.003 | less than 0.01 | 0.30 | 0.10 |
| | Sample 2 | Balance | 0.078 | 0.15 | 0.35 | 18.38 | 1.62 | 0.76 | 1.13 | 9.20 | 12.88 | 0.1 | 0.003 | less than 0.01 | 0.70 | 0.15 |
| | Sample 3 | Balance | 0.022 | 0.35 | 0.35 | 21.30 | 1.48 | 1.02 | 1.06 | 9.03 | 12.75 | 0.1 | 0.003 | less than 0.01 | 0.05 | 0.05 |
| | Sample 4 | Balance | 0.051 | 0.35 | 0.35 | 18.32 | 1.51 | 1.09 | 1.04 | 8.97 | 12.35 | 0.1 | 0.003 | less than 0.01 | 0.15 | 0.33 |
| | Sample 5 | Balance | 0.050 | 0.35 | 0.35 | 19.00 | 1.50 | 1.10 | 0.80 | 9.00 | 12.50 | 0.1 | 0.003 | less than 0.01 | 0.10 | 0.30 |
| | Sample 6 | Balance | 0.097 | 0.35 | 0.35 | 15.80 | 1.59 | 0.52 | 1.90 | 5.88 | 10.61 | 0.1 | 0.003 | less than 0.01 | 0.15 | 0 |
| | Sample 7 | Balance | 0.070 | 0.35 | 0.35 | 17.25 | 1.61 | 0.58 | 0.61 | 9.89 | 11.39 | 0.1 | 0.003 | less than 0.01 | 0.90 | 0 |
| | Sample 8 | Balance | 0.065 | 0.15 | 0.15 | 19.40 | 1.52 | 1.01 | 1.04 | 10.68 | 13.49 | 0.1 | 0.003 | less than 0.01 | 0 | 0.03 |
| | Sample 9 | Balance | 0.016 | 0.45 | 0.4 | 16.77 | 1.54 | 1.08 | 1.02 | 11.50 | 14.44 | 0.1 | 0.003 | less than 0.01 | 0 | 0.45 |
| COMPARATIVE EXAMPLE | Sample 10 | Balance | 0.050 | 0.35 | 0.35 | 18.20 | 1.56 | 0.43 | 1.02 | 9.05 | 12.55 | 0.1 | 0.003 | less than 0.01 | 0.15 | 0.10 |
| | Sample 11 | Balance | 0.590 | 0.35 | 0.35 | 18.22 | 1.58 | 2.20 | 0.97 | 9.05 | 12.66 | 0.1 | 0.003 | less than 0.01 | 0.28 | 0.16 |
| | Sample 12 | Balance | 0.070 | 0.35 | 0.35 | 18.61 | 1.58 | 1.05 | 0.25 | 9.05 | 12.47 | 0.1 | 0.003 | less than 0.01 | 0.10 | 0.10 |
| | Sample 13 | Balance | 0.070 | 0.35 | 0.35 | 18.47 | 1.59 | 0.99 | 3.22 | 9.05 | 12.40 | 0.1 | 0.003 | less than 0.01 | 0.28 | 0.20 |
| | Sample 14 | Balance | 0.058 | 0.08 | 0.35 | 18.35 | 1.59 | 1.05 | 0.91 | 4.10 | 9.80 | 0.1 | 0.003 | less than 0.01 | 0.10 | 0.23 |
| | Sample 15 | Balance | 0.061 | 0.6 | 0.35 | 18.74 | 1.59 | 0.98 | 0.85 | 13.60 | 16.20 | 0.1 | 0.003 | less than 0.01 | 0.05 | 0.10 |
| | Sample 16 | Balance | 0.070 | 0.35 | 0.35 | 18.18 | 1.57 | 1.05 | 1.10 | 9.05 | 12.69 | 0.1 | 0.003 | less than 0.01 | 0.02 | 0.005 |
| | Sample 17 | Balance | 0.070 | 0.35 | 0.35 | 18.30 | 1.59 | 0.98 | 0.95 | 9.05 | 12.80 | 0.1 | 0.003 | less than 0.01 | 1.00 | 0.10 |
| | Sample 18 | Balance | 0.009 | 0.35 | 0.086 | 14.21 | 1.60 | 1.04 | 1.10 | 9.05 | 12.63 | 0.1 | 0.003 | less than 0.01 | 0.15 | 0.10 |
| | Sample 19 | Balance | 0.120 | 0.35 | 0.65 | 26.00 | 1.59 | 1.11 | 1.03 | 9.05 | 12.54 | 0.1 | 0.003 | less than 0.01 | 0.28 | 0.27 |
| | Sample 20 | Balance | 0.068 | 0.35 | 0.35 | 18.66 | 1.59 | 0.85 | 0.89 | 9.22 | 13.50 | 0.1 | 0.003 | less than 0.01 | 0.04 | 0 |
| | Sample 21 | Balance | 0.055 | 0.35 | 0.35 | 18.24 | 1.65 | 0.70 | 0.61 | 9.36 | 12.98 | 0.1 | 0.003 | less than 0.01 | 1.20 | 0 |
| | Sample 22 | Balance | 0.049 | 0.35 | 0.35 | 18.70 | 1.54 | 1.02 | 1.05 | 9.41 | 12.82 | 0.1 | 0.003 | less than 0.01 | 0 | 0.02 |
| | Sample 23 | Balance | 0.070 | 0.35 | 0.35 | 19.02 | 1.55 | 0.96 | 1.02 | 9.33 | 12.45 | 0.1 | 0.003 | less than 0.01 | 0 | 0.60 |

High temperature strength properties of casting alloys of the sample 1 to the sample 23 were evaluated by tensile strength tests and creep rupture tests. By melting each 20 kg of the Ni-based alloys of the samples 1 to the sample 23 having chemical compositions represented in Table 1 in a vacuum induction furnace, ingots were fabricated. Subsequently, the ingot was subjected to a solution treatment at 1175° C. for 3 hours and to an aging treatment at 775° C. for 10 hours, made to be the casting alloy. Then, a test piece of a predetermined size was fabricated from the above casting alloy.

With regard to the tensile strength test, the tensile strength test was performed to the test piece by each sample, under conditions of temperatures of room temperature (24° C.) and 750° C., complying with JIS G 0567 (High temperature tensile test method for steel material and heat resistant alloy), and a 0.2% proof stress was measured. Here, the temperature condition of 750° C. in the tensile strength test was set in consideration of a temperature condition at a time of an activation operation of a steam turbine.

In the creep rupture test, creep rupture strength at a temperature of 750° C. for 100 thousand hours was measured to the test piece by each sample, complying with JIS Z 2271.

Further, evaluation of castability was done to each sample. In the evaluation of castability, the above-described ingot was vertically cut into two, and to a cross section, a penetrant test (PT) was performed complying with JIS Z 2343-1 (Nondestructive test-penetrant test-first section: general principle: penetrant test method and classification of penetrant flaw indication). Then, existence/absence of a casting crack was visually observed.

Results of the test described above will be represented in Table 2. In the results of the evaluation of castability represented in Table 2, a case that a casting crack does not exist is denoted as "Non-existence" and further the evaluation of castability is denoted as "good" to indicate that castability is superior. On the other hand, a case that a casting crack exists is denoted as "Existence", and further the evaluation of castability is denoted as "Poor" to indicate that castability is inferior.

TABLE 2

| | | 0.2% proof stress, MPa | | 750° C., 100 thouand hour creep | Castability | |
|---|---|---|---|---|---|---|
| | | 24° C. | 750° C. | strength, MPa | Casting crack | Evaluation |
| EXAMPLE | Sample 1 | 461 | 396 | 101 | Non-existence | Good |
| | Sample 2 | 484 | 377 | 105 | Non-existence | Good |
| | Sample 3 | 441 | 358 | 102 | Non-existence | Good |
| | Sample 4 | 452 | 373 | 98 | Non-existence | Good |
| | Sample 5 | 462 | 368 | 108 | Non-existence | Good |
| | Sample 6 | 432 | 354 | 110 | Non-existence | Good |
| | Sample 7 | 445 | 356 | 105 | Non-existence | Good |
| | Sample 8 | 428 | 342 | 99 | Non-existence | Good |
| | Sample 9 | 433 | 350 | 102 | Non-existence | Good |
| COMPARATIVE EXAMPLE | Sample 10 | 355 | 295 | 62 | Non-existence | Good |
| | Sample 11 | 432 | 376 | 110 | Existence | Poor |
| | Sample 12 | 301 | 241 | 67 | Non-existence | Good |
| | Sample 13 | 460 | 386 | 98 | Existence | Poor |
| | Sample 14 | 350 | 280 | 69 | Non-existence | Good |
| | Sample 15 | 380 | 302 | 96 | Existence | Poor |
| | Sample 16 | 407 | 322 | 76 | Non-existence | Good |
| | Sample 17 | 455 | 339 | 82 | Existence | Poor |
| | Sample 18 | 399 | 296 | 71 | Non-existence | Good |
| | Sample 19 | 421 | 304 | 83 | Existence | Poor |
| | Sample 20 | 366 | 309 | 77 | Non-existence | Good |
| | Sample 21 | 425 | 354 | 81 | Existence | Poor |
| | Sample 22 | 358 | 301 | 69 | Non-existence | Good |
| | Sample 23 | 419 | 320 | 72 | Existence | Poor |

As represented in Table 2, it is found that the sample 1 to the sample 9 have higher 0.2% proof stresses, and further, also have higher creep rupture strength as compared with the sample 10 to the sample 23, under each temperature condition. Further, it is found that the sample 1 to the sample 9 also have superior castability. It is considered that in the sample 1 to the sample 9, the 0.2% proof stresses and the creep rupture strength show high values because optimal harmony of precipitation strengthening and solid solution strengthening is achieved, and further, strength is enhanced by heat treatments.

On the other hand, with the sample 10 to the sample 23 according to the comparative examples, a superior result is not obtained in either a high temperature strength property or castability.

According to the embodiment described above, it becomes possible to obtain superior high temperature strength property and castability.

While certain embodiments have been described, these embodiments have been presented by way of example only, and are not intended to limit the scope of the invention. Indeed, the novel embodiment described herein may be embodiment in a variety of other forms; furthermore, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam turbine comprising at least one of a turbine casing, a valve casing, a nozzle box, a main steam pipe and a reheated steam pipe, wherein the at least one of a turbine casing, a valve casing, a nozzle box, a main steam pipe and a reheated steam pipe is made of an Ni-based casting alloy comprising nickel and, in percent (%) by mass:

C (carbon): 0.01 to 0.1,

Cr (chromium): 15 to 25,

Co (cobalt): 10 to 15,

Mo (molybdenum): 5 to 12,

Al (aluminum): 0.5 to 1.4,

Ti (titanium): 0.6 to 1.3,
B (boron): 0.001 to 0.006,
Ta (tantalum): 0.05 to 1,
Si (silicon): 0.1 to 0.5, and
Mn (manganese): 0.1 to 0.5.

2. The steam turbine according to claim 1, wherein a content ratio of a sum of Al and Ti is within a range of 1 to 3% by mass.

3. The steam turbine according to claim 1, consisting of nickel and, in percent (%) by mass:
C (carbon): 0.01 to 0.1,
Cr (chromium): 15 to 25,
Co (cobalt): 10 to 15,
Mo (molybdenum): 5 to 12,
Al (aluminum): 0.5 to 1.4,
Ti (titanium): 0.6 to 1.3,
B (boron): 0.001 to 0.006,
Ta (tantalum): 0.05 to 1,
Si (silicon): 0.1 to 0.5,
Mn (manganese): 0.1 to 0.5, and
unavoidable impurities.

4. A steam turbine comprising at least one of a turbine casing, a valve casing, a nozzle box, a main steam pipe and a reheated steam pipe,
wherein the at least one of a turbine casing, a valve casing, a nozzle box, a main steam pipe and a reheated steam pipe is made of an Ni-based casting alloy comprising nickel and, in percent (%) by mass:
C (carbon): 0.01 to 0.1,
Cr (chromium): 15 to 25,
Co (cobalt): 10 to 15,
Mo (molybdenum): 5 to 12,
Al (aluminum): 0.5 to 1.4,
Ti (titanium): 0.6 to 1.3,
B (boron): 0.001 to 0.006,
Nb (niobium): 0.025 to 0.5,
Si (silicon): 0.1 to 0.5, and
Mn (manganese): 0.1 to 0.5.

5. The steam turbine according to claim 4, wherein a content ratio of a sum of Al and Ti is within a range of 1 to 3% by mass.

6. The steam turbine according to claim 4, consisting of nickel and, in percent (%) by mass:
C (carbon): 0.01 to 0.1,
Cr (chromium): 15 to 25,
Co (cobalt): 10 to 15,
Mo (molybdenum): 5 to 12,
Al (aluminum): 0.5 to 1.4,
Ti (titanium): 0.6 to 1.3,
B (boron): 0.001 to 0.006,
Nb (niobium): 0.025 to 0.5,
Si (silicon): 0.1 to 0.5,
Mn (manganese): 0.1 to 0.5 and
unavoidable impurities.

7. A steam turbine comprising at least one of a turbine casing, a valve casing, a nozzle box, a main steam pipe and a reheated steam pipe,
wherein the at least one of a turbine casing, a valve casing, a nozzle box, a main steam pipe and a reheated steam pipe is made of an Ni-based casting alloy comprising nickel and, in percent (%) by mass:
C (carbon): 0.01 to 0.1,
Cr (chromium): 15 to 25,
Co (cobalt): 10 to 15,
Mo (molybdenum): 5 to 12,
Al (aluminum): 0.5 to 1.4,
Ti (titanium): 0.6 to 1.3,
B (boron): 0.001 to 0.006,
Si (silicon): 0.1 to 0.5,
Mn (manganese): 0.1 to 0.5, and
a sum of Ta (tantalum) and Nb (niobium) of 0.1 to 1, where each of Ta and Nb are at least equal to 0.01.

8. The steam turbine according to claim 7, consisting of nickel and, in percent (%) by mass:
C (carbon): 0.01 to 0.1,
Cr (chromium): 15 to 25,
Co (cobalt): 10 to 15,
Mo (molybdenum): 5 to 12,
Al (aluminum): 0.5 to 1.4,
Ti (titanium): 0.6 to 1.3,
B (boron): 0.001 to 0.006,
Si (silicon): 0.1 to 0.5,
Mn (manganese): 0.1 to 0.5,
a sum of Ta (tantalum) and Nb (niobium) of 0.1 to 1, where each of Ta and Nb are at least equal to 0.01 and unavoidable impurities.

9. The steam turbine according to claim 7, wherein a content ratio of a sum of Al and Ti is within a range of 1 to 3% by mass.

10. The steam turbine according to claim 7,
wherein the sum of Ta and Nb has a total molar number being equal to a molar number of Ta having equal mass number to a mass number of the sum of Ta and Nb.

11. The steam turbine according to claim 10, wherein a content ratio of a sum of Al and Ti is within a range of 1 to 3% by mass.

* * * * *